US008777480B2

(12) United States Patent
Silvant

(10) Patent No.: US 8,777,480 B2
(45) Date of Patent: Jul. 15, 2014

(54) ROTATING BEZEL SYSTEM

(71) Applicant: Omega SA, Bienne (CH)

(72) Inventor: Olivier Silvant, Macolin (CH)

(73) Assignee: Omega S.A., Bienne (CH)

( * ) Notice: Subject to any disclaimer, the term of this patent is extended or adjusted under 35 U.S.C. 154(b) by 0 days.

(21) Appl. No.: 13/905,834

(22) Filed: May 30, 2013

(65) Prior Publication Data

US 2013/0329536 A1 Dec. 12, 2013

(30) Foreign Application Priority Data

Jun. 6, 2012 (EP) ..... 12171071

(51) Int. Cl.
*G04B 19/18* (2006.01)

(52) U.S. Cl.
USPC ..... 368/295

(58) Field of Classification Search
USPC ..... 368/294–295
See application file for complete search history.

(56) References Cited

U.S. PATENT DOCUMENTS

| | | | | |
|---|---|---|---|---|
| 3,662,537 | A * | 5/1972 | Fujimori | 368/295 |
| 4,420,264 | A * | 12/1983 | Murata | 368/223 |
| 4,479,724 | A * | 10/1984 | Matsumoto et al. | 368/291 |
| 4,815,053 | A * | 3/1989 | Dal Busco | 368/294 |
| 5,122,997 | A | 6/1992 | Schneider et al. | |
| 5,541,895 | A * | 7/1996 | Nussbaum | 368/295 |
| 2001/0040840 | A1 | 11/2001 | Terasawa et al. | |
| 2003/0206493 | A1 * | 11/2003 | Carrard et al. | 368/10 |

FOREIGN PATENT DOCUMENTS

| | | |
|---|---|---|
| CH | 563 030 | 6/1975 |
| CH | 662 922 G A3 | 11/1987 |
| CH | 703 400 A2 | 1/2012 |
| EP | 0 403 717 A1 | 12/1990 |
| EP | 1 139 185 A1 | 10/2001 |

OTHER PUBLICATIONS

European Search Report issued Nov. 30, 2012, in European Application No. 12 17 1071 filed Jun. 6, 2012 (with English Translation).

* cited by examiner

*Primary Examiner* — Sean Kayes
(74) *Attorney, Agent, or Firm* — Oblon, Spivak, McClelland, Maier & Neustadt, L.L.P.

(57) ABSTRACT

The invention concerns a timepiece comprising a middle part (30) closed by a back cover and a crystal, said middle part (30) comprising a peripheral shoulder (34) in which a groove (37) is arranged, said groove being disposed on a surface of the shoulder parallel to the central axis of the middle part (C), said timepiece comprising a rotating bezel system (20) rotatably mounted on said peripheral shoulder, characterised in that said rotating bezel system includes a bezel ring (40, 41) provided with at least a first recess (46) disposed on a surface of the bezel intended to face said groove when said rotating bezel system (20) is fitted onto the middle part, said rotating bezel system (20) further comprising a spring means (80) extending both into said at least one first recess (46) of the bezel and at the same time into the groove (37) in the middle part so as to hold the rotating bezel system (20) on the middle part (30) of the timepiece.

10 Claims, 4 Drawing Sheets

ROTATING BEZEL SYSTEM

This application claims priority from European Patent Application No. 12171071.9 filed Jun. 6, 2012, the entire disclosure of which is incorporated herein by reference.

The present invention concerns a timepiece comprising a middle part closed by a back cover and a crystal, said timepiece further comprising a rotating bezel system secured to said middle part.

The technical field of the invention is the technical field of fine mechanics.

BACKGROUND OF THE INVENTION

The present invention concerns a rotating bezel system for a timepiece.

Known rotating bezel systems 2, seen in FIG. 1, comprise a rotating bezel 4 taking the form of an annular part having a top surface and a bottom surface, with the top surface being the part visible to the user. This bezel has a notch 6 on the bottom surface thereof. The rotating bezel system further includes a spring means 8. This spring means 8 is inserted between the rotating bezel and the middle part 3 of timepiece 1, when bezel 4 is forcibly fitted onto the middle part of the timepiece. This spring means 8 takes the form of a flat ring comprising leaves on the surface thereof facing the notch in the bezel. These leaves are arranged to tilt relative to the plane of the flat ring. The leaves have some elasticity so that the spring means acts on the rotating bezel to exert a vertical force. This vertical force has a tendency to push the bezel off the middle part of the timepiece.

Further, the leaves serve to cooperate with the notch in the bottom surface of the bezel. The leaves and notch are thus configured so that the bezel can only rotate in one direction. The leaves prevent the bezel from rotating if the user attempts to rotate said bezel in the wrong direction. Generally, the bezel and the spring means are made of steel which has the advantage of being durable and inexpensive.

The bezel is driven onto the middle part of the watch case. To achieve this, the middle part has a peripheral shoulder in which said rotating bezel system is placed, the vertical wall of said shoulder having a peripheral groove 10. The bezel is an annular part having a peripheral rim on the bottom surface thereof. The rim is provided with a continuous protruding portion 12 extending along said rim towards the axial centre of the bezel. When said rotating bezel system is driven onto the middle part of the watch case, the continuous protruding portion is inserted into the peripheral groove of the shoulder ensuring that the bezel is held vertically on the middle part.

One drawback of this system is that it requires significant force to assemble said rotating bezel system. Indeed, when the bezel is forcibly fitted onto said middle part so that the continuous protruding portion is inserted into the peripheral groove, significant stresses are applied to the bezel. These stresses may, if incorrectly applied, cause deformations of the bezel and thus malfunction of the rotating bezel system.

Moreover, the snap fit assembly of the bezel is permanent. Indeed, it is impossible to remove the rotating bezel system from the middle part afterwards. Attempts to remove said rotating bezel system result in the destruction of said system.

SUMMARY OF THE INVENTION

It is an object of the invention to overcome the drawbacks of the prior art by proposing to provide a rotating bezel system for a timepiece which is simpler to assemble onto the watch case, imposing less stress on said system and which can be more easily disassembled.

The invention therefore concerns a timepiece comprising a middle part closed by a back cover and a crystal, said middle part comprising a peripheral shoulder in which a groove is arranged, said groove being disposed on a surface of the shoulder parallel to the central axis of the middle part, said timepiece comprising a rotating bezel system rotatably mounted on said peripheral shoulder, characterised in that said rotating bezel system includes a bezel ring provided with at least a first recess disposed on a surface of the bezel intended to face said groove when said rotating bezel system is fitted onto the middle part, said rotating bezel system further comprising a spring means extending both into said at least one first recess of the bezel and at the same time into the groove in the middle part so as to hold the rotating bezel system on the middle part of the timepiece, and a toothed element having a toothing arranged to cooperate with a corresponding toothing arranged on the spring means so as to index the angular position of the bezel.

A first advantage of the present invention is that the rotating bezel system according to the invention is simpler to assemble. Indeed the system according to the present invention takes the form of a pre-assembled system. It is thus clear that the various elements forming the rotating bezel system are assembled to each other and that, afterwards, said system only needs be secured to the middle part of the watch case. Thus, it is simpler to store and transport the rotating bezel systems since they are already assembled.

A second advantage is that less stress is required for assembly with the present invention. Indeed, since the spring means is the means for retaining the rotating bezel system on the middle part of the watch case, the stress exerted during assembly is partly absorbed. This stress is absorbed by the spring which will deform and facilitate assembly.

In a first advantageous embodiment, the spring means includes a spring ring in the form of an open ring with at least one zone having a minimum radius and one zone having a maximum radius so that the zone having a maximum radius cooperates with said at least one first recess and the zone having the minimum radius cooperates with the groove in the peripheral shoulder.

In a advantageous embodiment, the bezel comprises a second recess in which the toothed element is arranged.

In a advantageous embodiment, said spring ring is a flat ring whose toothing is arranged on the external wall of said at least one zone having a minimum radius, the first and second recesses then merging.

In a advantageous embodiment, said spring ring comprises two ends, one of which has a raised part, said raised part comprising a vertically oriented curved portion and a flat portion parallel to said spring ring, said flat portion comprising, on the external wall thereof, the toothing cooperating with the toothed element.

In another advantageous embodiment, the bezel is made in at least two parts and includes a bezel ring and a support ring having complementary profiles so that assembling the bezel ring to the support ring forms the first and second merged recesses.

In another advantageous embodiment, the bezel is made in at least two parts and includes a bezel ring and a support ring having complementary profiles so that assembling the bezel ring to the support ring forms the second recess, said support ring comprising the first recess.

In another advantageous embodiment, said spring ring has three angularly distributed zones having a minimum radius.

In another advantageous embodiment, the zones of said spring ring having a minimum radius are angularly distributed.

In another advantageous embodiment, said toothing is arranged on each zone having a minimum radius.

BRIEF DESCRIPTION OF THE DRAWINGS

The objects, advantages and features of the bezel system according to the present invention will appear more clearly in the following detailed description of at least one embodiment of the invention, given solely by way of non-limiting example and illustrated by the annexed drawings, in which.

DETAILED DESCRIPTION OF THE INVENTION

The present invention proceeds from the general inventive idea which consists in providing a rotating bezel system which is simpler to assemble.

Figure 1:
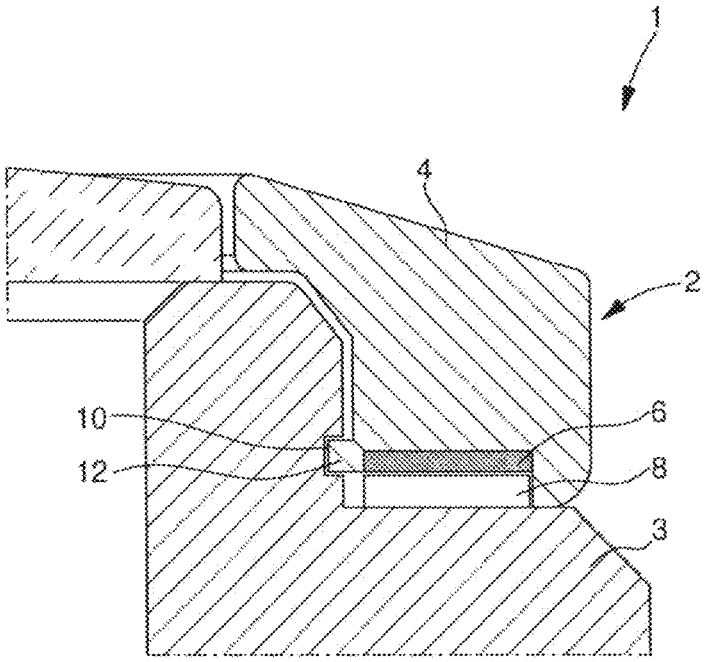
FIG. 1 is a schematic view of a bezel system of the prior art.
Figure 2:
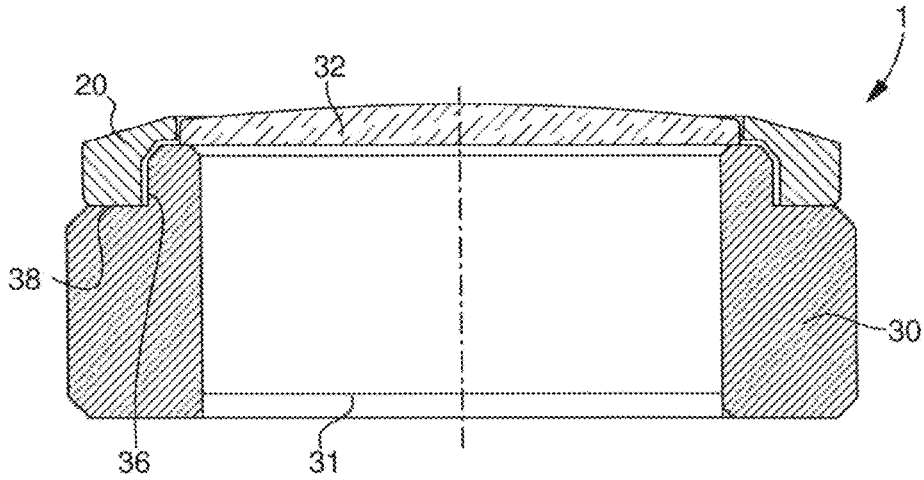
FIG. 2 is a cross-section of a timepiece provided with a bezel system.

A timepiece 1, seen in FIG. 2, comprises a middle part 30 closed by a back cover 31 and a crystal 32. This middle part 30 includes a peripheral shoulder 34 defined by a lateral wall 36 and a base 38. This shoulder 34 defines a site in which the rotating bezel system 20 is placed.

Figure 3:
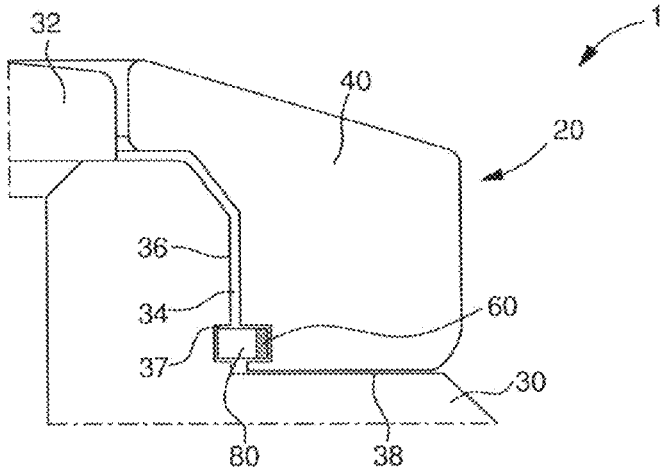
FIG. 3 is a schematic view of the bezel system according to the invention.

Rotating bezel system 20, seen in FIG. 3, includes a bezel 40, which is the visible part handled by the user. Rotating bezel system 20 also includes a toothed element 60 arranged on bezel 40 and a spring means 80 cooperating with toothed element 60 to allow rotating bezel system 20 to rotate relative to middle part 30 of timepiece 1.

Advantageously according to the invention, spring means 80 is also used to hold rotating bezel system 20 on middle part 30 of watch case 1.

Figure 4:
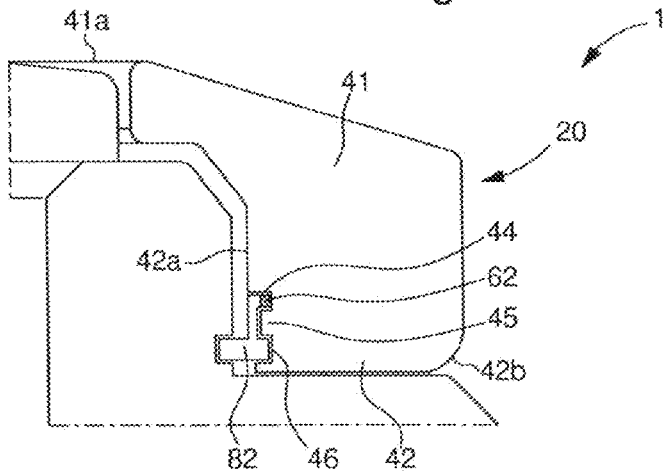
FIG. 4 is a schematic view of a first embodiment of the bezel system of the invention.

In a first embodiment shown in FIG. 4, spring means 80 takes the form of a spring with several levels, in three dimensions.

Rotating bezel system 20 of this embodiment includes a bezel 41. This bezel 41 takes the form for example of a ring comprising a top surface 41*a* and a bottoms surface 41*b*. From the bottom surface 41*b*, a peripheral rim 42 extends perpendicularly to the plane of bezel 41. This peripheral rim 42 includes an inner lateral wall 42*a* and an outer lateral wall 42*b*. The inner lateral wall 42*a* has a second recess 44 having a parallelepiped profile such as a square or rectangular profile. This second recess 44 covers the entire length of said rim 42 so as to be circular. Toothed element 60 is arranged in this second recess 44. This toothed element 60 may take the form of a toothing 61 made directly in said first recess of the rim or, as in the illustrated example, the form of a toothed ring 62 carrying a toothing 63 on the inner surface thereof. This toothed ring 62 is placed in said second recess 44. Means are provided for angularly securing said toothed ring 62 to bezel 41, such as for example spot welds or adhesive spots. However, toothing 63 forming toothed element 60 could be made directly on the inner lateral wall 42*a* of peripheral rim 42, there being no second recess 44 in rim 42.

Figure 5:
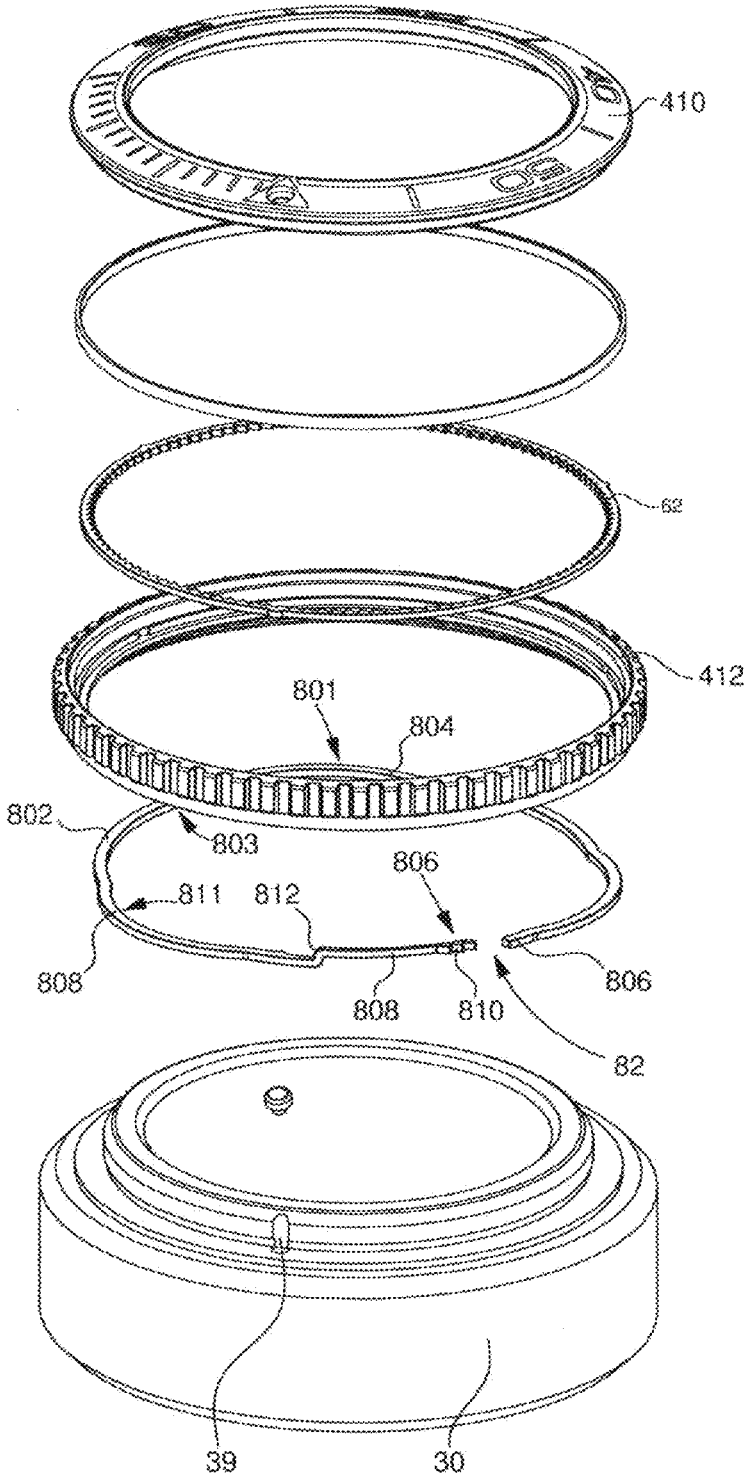
FIGS. 5 to 6 are schematic views of the spring of the first embodiment of the bezel system of the invention.
Figure 6:
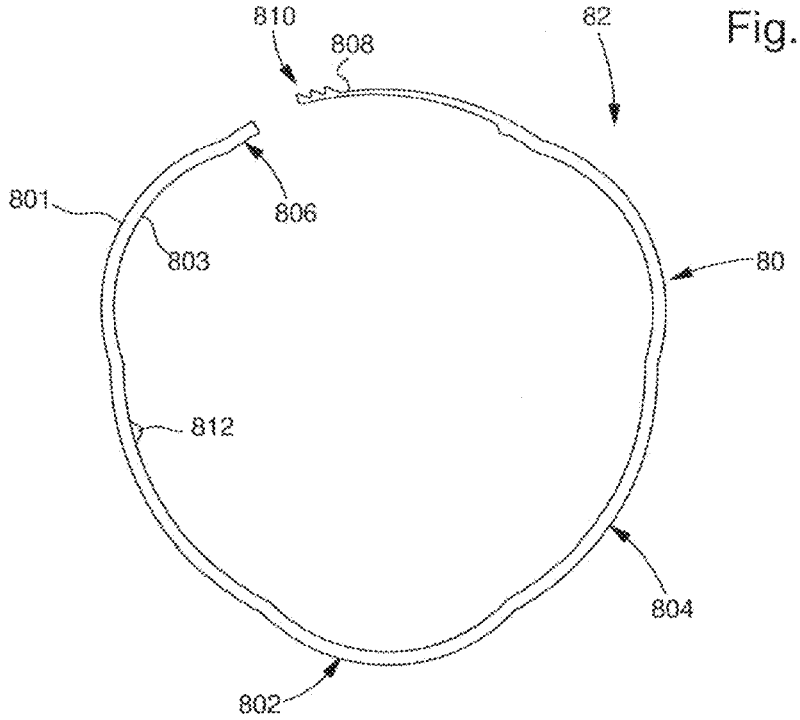

Spring means 80, seen in FIGS. 5 and 6, takes the forms of a spring ring 82. This spring ring has a top surface and a bottom surface, said top surface being the surface visible from above when said spring ring is placed on any level. The spring ring comprises an open ring 800, comprising at least one zone having a smaller radius of curvature than the radius of curvature of said non-closed ring. It is thus clear that said spring ring includes at least one zone 802 having a maximum radius and at least one zone 804 having a minimum radius. In the case shown in FIG. 5, the spring ring includes three regularly angularly distributed zones 802 having a minimum radius. Said open ring 800 also has, at one of the ends 806 thereof, a raised part 808. This means that said end has an axial or vertical curvature so that the end is raised and parallel to the plane of spring ring 800. The raised part thus includes an axially oriented curved portion 808*a* and a flat portion 808*b* parallel to said spring ring 82. Preferably, this curvature extends from the top surface of spring ring 82. This raised part 808 includes a toothing 810 on the external surface thereof. This toothing 810 is complementary to the toothing of toothed element 60, i.e. toothing 63 of toothed ring 62 or toothing 61. Indeed, when spring ring 82 is fitted into rotating bezel system 20, the raised part of spring ring 82 is calculated such that said ring faces toothed ring 62.

To mount spring ring 82 in bezel 41, the bezel has a recess for a spring 46 having a square or rectangular profile which also covers the entire length of said rim 42. This first recess 46 is located underneath second recess 44 so that a separating wall 48 separates second recess 44 from first recess 46. The separating wall 48 is preferably shortened so that the second recess 44 and first recess 46 communicate with each other to form a housing 45 for spring ring 82. Consequently, when the spring ring is assembled, toothing 810 of the outer surface of raised part 808 comes into contact with the toothing of the inner surface of toothed ring 62, and spring ring 82 is locked into said bezel 41. The at least one zone 804 having a minimum radius is/are inserted into first recess 46. Consequently, when toothed ring 62 and spring ring 82 are assembled in bezel 41, only the at least one zone 802 of maximum radius juts out.

The cooperation between toothing 63 of toothed ring 62 and toothing 810 of raised part 808 of spring ring 82 determines the direction of rotation of rotating bezel system 20. To achieve this, toothing 810 of the outer surface of raised part 808 and the toothing of the inner surface of toothed ring 62 are configured such that each tooth includes an inclined surface and a surface that is straight or merges with radius of toothed ring 62 or of spring ring 82. When spring ring 82 is mounted in rotating bezel system 20, the inclined surface of each tooth of toothing 810 of spring ring 82 is in contact with the inclined surface of each tooth of toothing 63 of toothed ring 62. The rotation of the system is unidirectional, i.e. rotation can occur clockwise or anti-clockwise, however it is possible for rotation to be two-directional. Indeed, if rotating bezel system 20 is rotated in the right direction, the inclined surfaces of the toothing of spring ring 82 and of the toothing of toothed ring 62 slide onto each other to mesh. Conversely, if rotating bezel system 20 is rotated in the wrong direction, the straight surfaces of toothed ring 62 abut on the straight surfaces of spring ring 82 forming a blockage.

The lateral wall 36 of shoulder 34 of middle part 30 includes a groove 37 extending along the lateral wall 36 so as to go around shoulder 34. This groove 37 is used to secure said rotating bezel system 20. Indeed, when rotating bezel system 20 is assembled on middle part 30 of the watch, driving in said rotating bezel system 20 causes tension stress to be applied to spring ring 82. As a result of this stress, spring ring 82 is taut and its diameter increases, the spring ring then tending to completely enter the first recess 46, thereby facilitating the driving in operation.

When spring ring 82 is facing groove 37 located on middle part 30, the stress exerted on said spring ring 82 decreases. The spring ring relaxes to return to its initial position. As they relax, the zones of the spring ring having a maximum radius 802 are inserted into groove 37 of middle part 30 to ensure vertical retention.

There is thus obtained a rotating bezel system 20 wherein the zones of spring ring 82 having a maximum radius 802 are inserted into groove 37 of middle part 30 and wherein the zones having a minimum radius 804 are inserted into first recess 46.

Moreover, spring ring 82 has at least one protruding portion 812 on the inner surface 803 thereof. This protruding portion 812 is arranged to cooperate with a hole 39 located on middle part 30 as seen in FIG. 5. This hole 39 is placed such that the protruding portion 812 is inserted therein when the rotating bezel system 20 is mounted on middle part 30. This cooperation locks spring ring 82 angularly relative to middle part 30.

There is thus obtained a spring ring 82 angularly integral with middle part 30 and a bezel 41 which comprises toothed element 60 which can rotate about middle part 30 in at least one predetermined direction. Indeed, when the user decides to rotate rotating bezel system 20, he has two possibilities: either he rotates rotating bezel system 20 in the direction in which it is intended to rotate, or in the opposite direction. Depending on the direction in which the user rotates the bezel, the teeth of spring ring 82 and the teeth of toothed ring 62 slide over each other to mesh or abut on each other to block rotation.

One advantage of rotating bezel system 20 of the invention is that it is easier to assemble on middle part 30 since the stress to be exerted is lower. Indeed, in known systems, vertical retention is achieved by driving in a rigid element which requires exerting significant force to drive in rotating bezel system 20. This also means that the operation of detaching rotating bezel system 20 from middle part 30 is very complicated, since there is a significant risk of said system breaking. With rotating bezel system 20 of the invention using an elastic element to ensure vertical retention, it is spring ring 82 which is used for vertical retention and which is deformed during the driving in operation. The stress that has to be applied to assemble rotating bezel system 20 of the invention to middle part 30 is thus lower. Consequently, the operation of detaching rotating bezel system 20 from middle part 30 is less complicated. Another consequence is a reduced risk of breaking said rotating bezel system 20.

Figure 7:
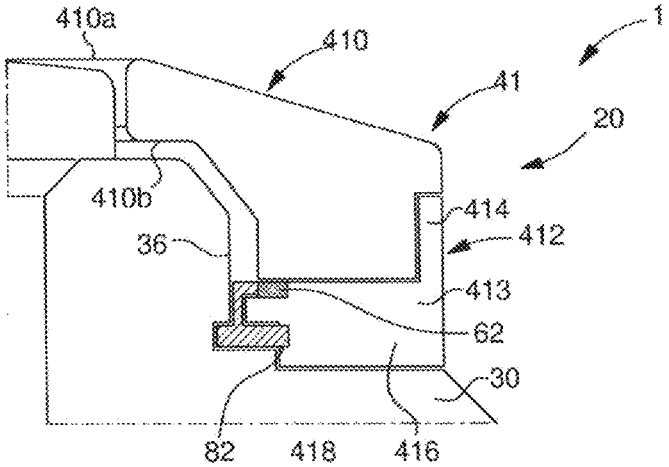
FIG. 7 is a schematic view of a variant of the first embodiment of the bezel system of the invention.

In a variant of this second embodiment seen in FIG. 7, bezel 41 is formed of several parts. Bezel 41 includes a bezel ring 410 and a support element 412 assembled to each other. Bezel ring 410 consists of a ring comprising a top surface 410*a* and a bottom surface 410*b*. Support element 412 takes the form of a support ring 413 having a top surface and a bottom surface. The top surface includes a peripheral top rim 414 having a stair-shaped profile. It is thus clear that said rim has several levels or support surfaces. As a minimum, the peripheral top rim 414 will include at least an intermediate level, support element 412 therefore including three support surfaces at three different heights. The bottom surface includes a peripheral bottom rim 416 extending perpendicularly relative to the plane of support element 412. The latter has a first recess 418 covering the inner surface of second rim 416 so as to form a circular recess. Bezel ring 410 also has a stair-shaped but complementary profile. This complementary stair-shaped profile is arranged to cooperate with the stair-shaped profile of support element 412. Thus, when the bezel is assembled, toothed ring 62 is placed on one of the support surfaces of support ring 412, preferably, the lowest surface. Then, bezel ring 410 is assembled to support ring 413 by a driving in, screwing or any other securing method. The stair-shaped profiles of bezel ring 410 and of support ring 413 work together. Preferably, the stair-shaped profiles are arranged so as to form the second recess 44 in which toothed ring 62 is placed. Toothed ring 62 is held between bezel ring 410 and support ring 413. Spring ring 82 is secured to bezel 41 so that the zones having a maximum radius 802 are inserted into the first recess 418 of the bottom rim 416. Consequently, in this case, the raised part 808 of spring ring 82 and more particularly toothing 810 of said raised part, cooperates with the toothing of toothed ring 62.

Figure 8:
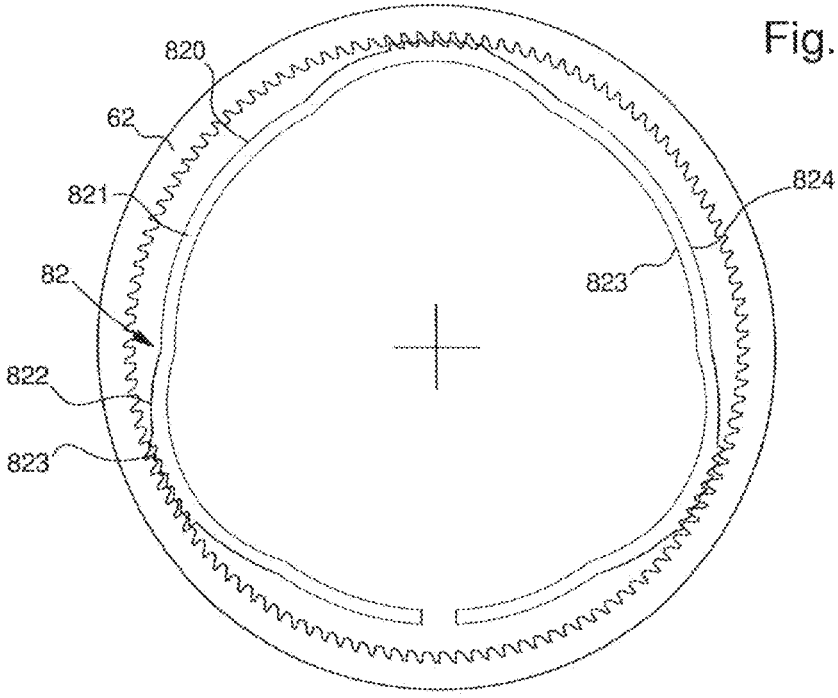
FIG. 8 is a schematic view of a second embodiment of the bezel system of the invention.

In a second embodiment visible in FIG. 8, spring ring 82 has no raised part. Said spring ring 82 is an open or non-closed ring 820 comprising at least one zone having a maximum radius 822 and at least one zone having a minimum radius 821. In the case shown in FIG. 8, the spring ring includes three, regularly angularly spaced zones having a maximum radius 822. This second embodiment is different in that the toothing 823 cooperating with the toothing of toothed element 62 is placed on said at least one zone having a maximum radius 822. This arrangement simplifies the bezel since only one recess has to be arranged on the inner wall of the bezel or of the support element, as seen in FIG. 3.

It will be clear that various alterations and/or improvements and/or combinations evident to those skilled in the art may be made to the various embodiments of the invention set out above without departing from the scope of the invention defined by the annexed claims.

What is claimed is:

1. A timepiece comprising a middle part closed by a back cover and a crystal, said middle part comprising a peripheral shoulder in which a groove is arranged, said groove being disposed on a shoulder surface parallel to the central axis of the middle part, said timepiece comprising a rotating bezel system rotatably mounted on said peripheral shoulder, wherein said rotating bezel system includes a bezel ring provided with at least a first recess disposed on a surface of the bezel intended to face said groove when said rotating bezel system is assembled on the middle part, said rotating bezel system further comprising a spring means extending both into said at least one first recess of the bezel and into the groove of the middle part to hold the rotating bezel system on the middle part of the timepiece, and a toothed element having a toothing arranged to cooperate with a corresponding toothing arranged on the spring means so as to index the angular position of the bezel.

2. The timepiece according to claim 1, wherein the spring means includes a spring ring in the form of an open ring having at least one zone having a minimum radius and one zone having a maximum radius so that the zone having a maximum radius cooperates with said at least one first recess and so that the zone having a minimum radius cooperates with the groove of the peripheral shoulder.

3. The timepiece according to claim 2, wherein said spring ring is a flat ring whose toothing is arranged on the external wall of said at least one zone having a minimum radius, the first and second recesses then being merged.

4. The timepiece according to claim 3, wherein the bezel is made in at least two parts and includes a bezel ring and a support ring having complementary profiles so that assembling the bezel ring to the support ring merges the first and second recesses.

5. The timepiece according to claim 3, wherein said toothing is arranged on each zone having a maximum radius.

6. The timepiece according to claim 2, wherein said spring ring comprises two ends one of which has a raised part, said raised part including a vertically oriented curved portion and a flat portion parallel to said spring ring, said flat portion comprising, on the external wall thereof, the toothing cooperating with the toothed element.

7. The timepiece according to claim 6, wherein the bezel is made in at least two part and includes a bezel ring and a support ring having complementary profiles so that assembling the bezel ring to the support ring forms the second recess, said support ring comprising the first recess.

8. The timepiece according to claim 2, wherein said spring ring comprises three, angularly distributed zones having a minimum radius.

9. The timepiece according to claim 8, wherein the zones having a minimum radius of said spring ring are angularly distributed.

10. The timepiece according to claim 1, wherein the bezel comprises a second recess in which the toothed element is arranged.

* * * * *